United States Patent [19]

Jinno et al.

[11] Patent Number: 4,737,102

[45] Date of Patent: Apr. 12, 1988

[54] BURNER FOR WATER HEATER

[75] Inventors: Hideyuki Jinno, Aichi; Yoshihiro Ishikawa, Gifu, both of Japan

[73] Assignee: Rinnai Corporation, Japan

[21] Appl. No.: 922,583

[22] Filed: Oct. 24, 1986

[30] Foreign Application Priority Data

Sep. 12, 1986 [JP] Japan ..... 61-141150[U]
Oct. 25, 1986 [JP] Japan ..... 60-164961[U]

[51] Int. Cl.[4] ..... F23D 14/12

[52] U.S. Cl. ..... 431/328; 126/92 R; 126/350 R; 126/351

[58] Field of Search ..... 431/328, 329; 126/92 R, 126/350 R, 351

[56] References Cited

U.S. PATENT DOCUMENTS 3,040,805 6/1962 Lambert ..... 431/329
3,129,749 4/1964 Hönger ..... 431/329
3,315,646 4/1967 Witten, Jr. ..... 122/235
3,424,146 1/1969 Patrick et al. ..... 126/92 R
4,039,275 8/1977 McGettrick ..... 431/329

FOREIGN PATENT DOCUMENTS 52-36341 3/1977 Japan ..... 431/329

*Primary Examiner*—Samuel Scott
*Assistant Examiner*—Allen J. Flanigan
*Attorney, Agent, or Firm*—Nilsson, Robbins, Dalgarn, Berliner, Carson & Wurst

[57] ABSTRACT

A burner apparatus is disclosed having a burner body and a burner case with a thermally insulated metal bracket interposed therebetween to connect the burner body to the burner case and control the temperature rise of the burner case during operation of the apparatus with respect to the temperature of the burner body.

5 Claims, 6 Drawing Sheets

FIG. 5
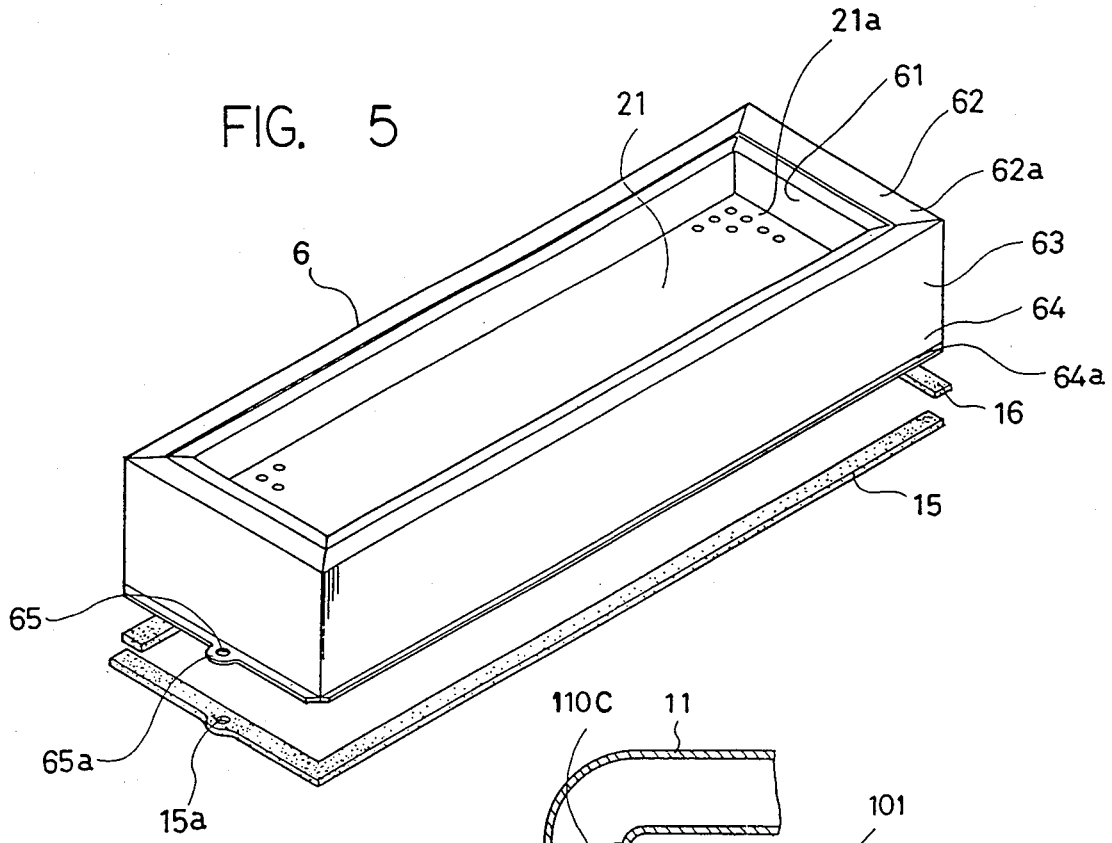
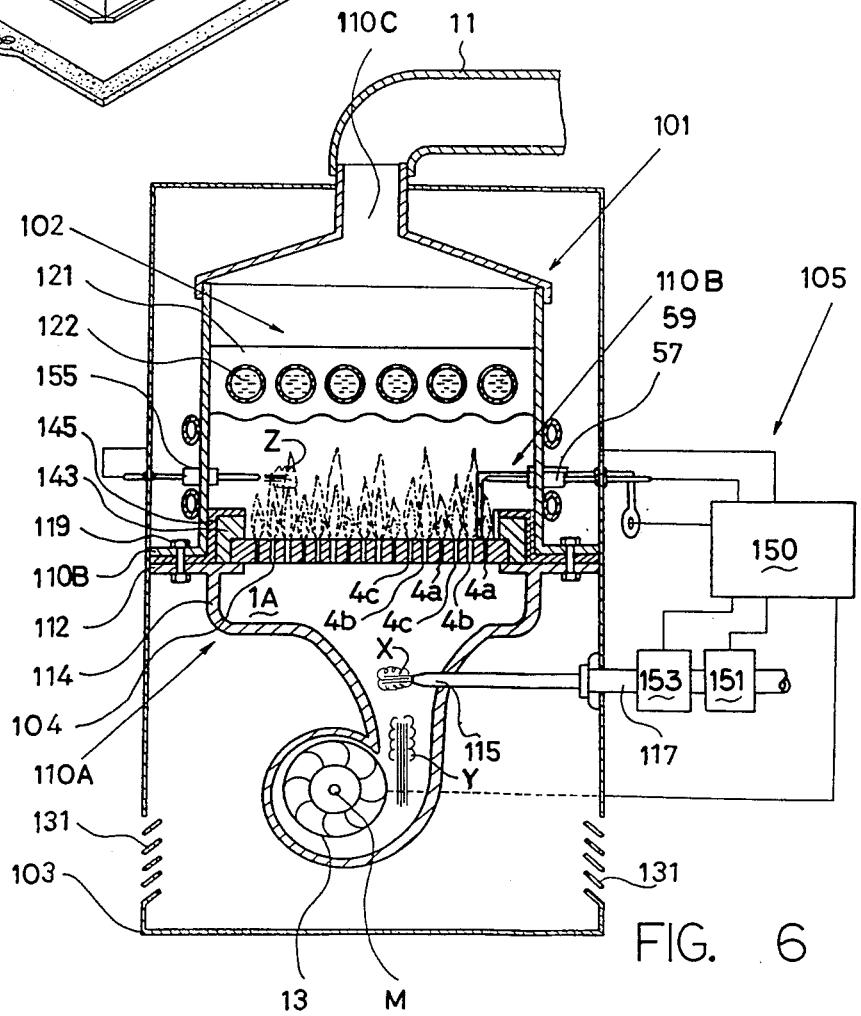
FIG. 6

BURNER FOR WATER HEATER

FIELD OF THE INVENTION

The present invention relates to a burner appliance with blower which is improved to keep the temperature of a burner body from abnormally rising.

BACKGROUND AND SUMMARY OF THE INVENTION

A water heater employed with such as, for example, a hot tub, has been provided with a heat exchanger. This heat exchanger is installed in contact with plate fins at the inner wall of a burner case. Below the heat exchanger, the water heater is provided with a gas burner fixed by means of a metal bracket. However, the heat exchanger thus structured prevents the metal tool from being exposed to burner flame, eliminating the necessity of taking its heat-resistant property into consideration.

In recent years, a gas burner has been introduced which employs a blower to fan air and fuel gas for the purpose of achieving high heater capacity. In this instance, the metal bracket has a portion exposed to a burning chamber within the case. The exposed portion of the metal bracket may reach a temperature as high as 1500 degrees centigrade, which is too high for the metal bracket to endure. One embodiment of this invention avoids this problem. According to this embodiment, a metal bracket is in direct contact with a burner case, so that thermal transfer is swiftly executed by way of the burner case to plate fins of a heat exchanger. This makes it possible to prevent the temperature of the metal bracket from abnormally rising. A burner body is provided which has an inlet at the upper reach of the burner case. The inlet acts to introduce a mixture of air and fuel gas. When in use, the burner body is in the condition of being subjected to heat, rendering it difficult to smoothly introduce the mixture gas through the inlet into the burner body.

With this in mind, the object of a further embodiment is to provide a burner appliance with a blower which is capable of maintaining a substantially uniform temperature of the burner body and, at the same time, secure smooth introduction of the mixture gas.

Although the novel features which are characteristic of this invention are set forth in more detail in the claims appended hereto, the nature and scope of the invention may be better understood by referring to the following description taken in connection with the accompanying drawings forming a part thereof, in which a specific embodiment has been set forth for the purpose of illustration.

BRIEF DESCRIPTION OF THE DRAWINGS

FIG. 5 is a perspective view of a metal bracket;

FIG. 6 is a sectional view of a water heater;

DETAILED DESCRIPTION OF THE INVENTION

Figure 1:
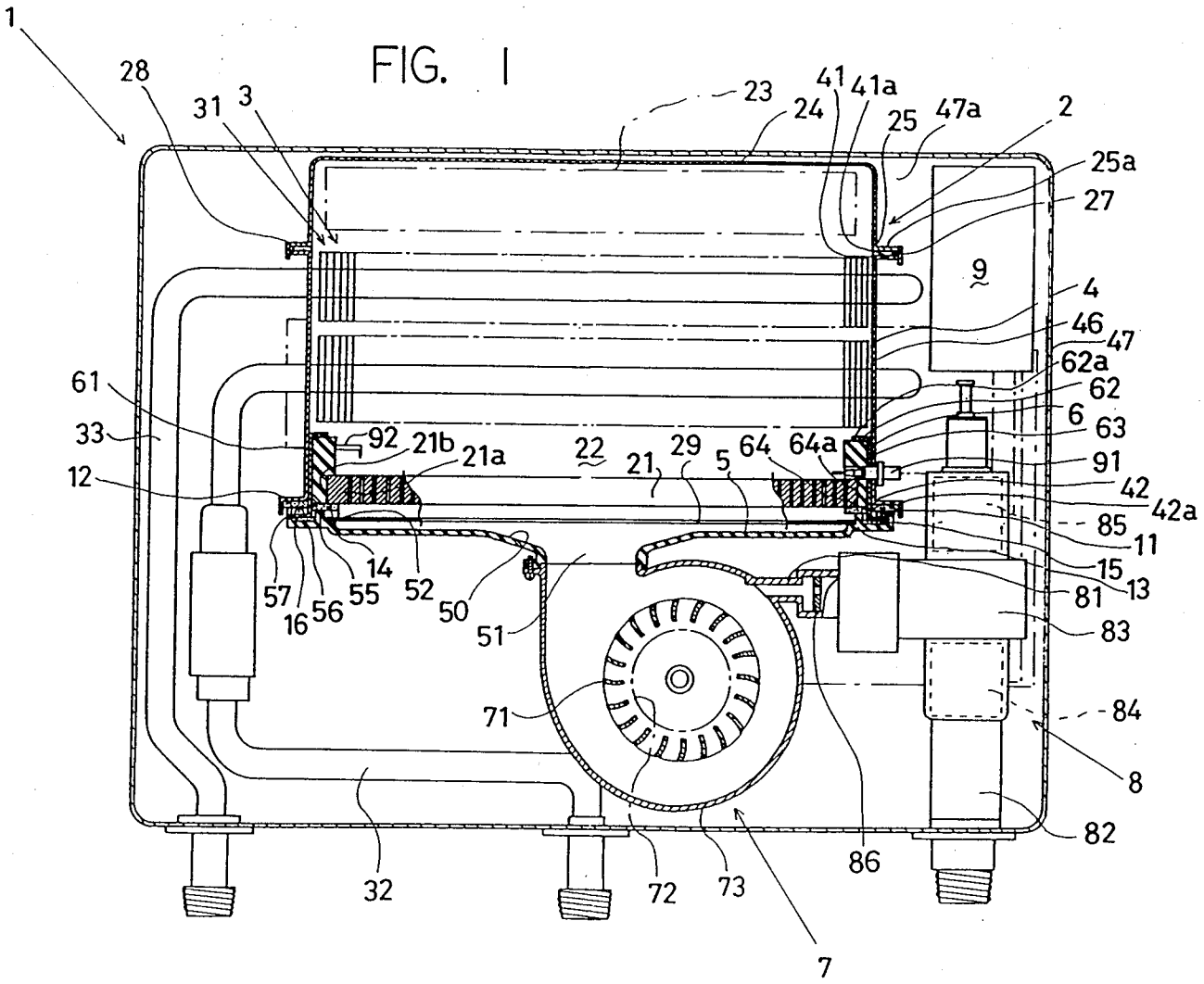
FIG. 1 is a longitudinal sectional view of a water heater.
Figure 2:
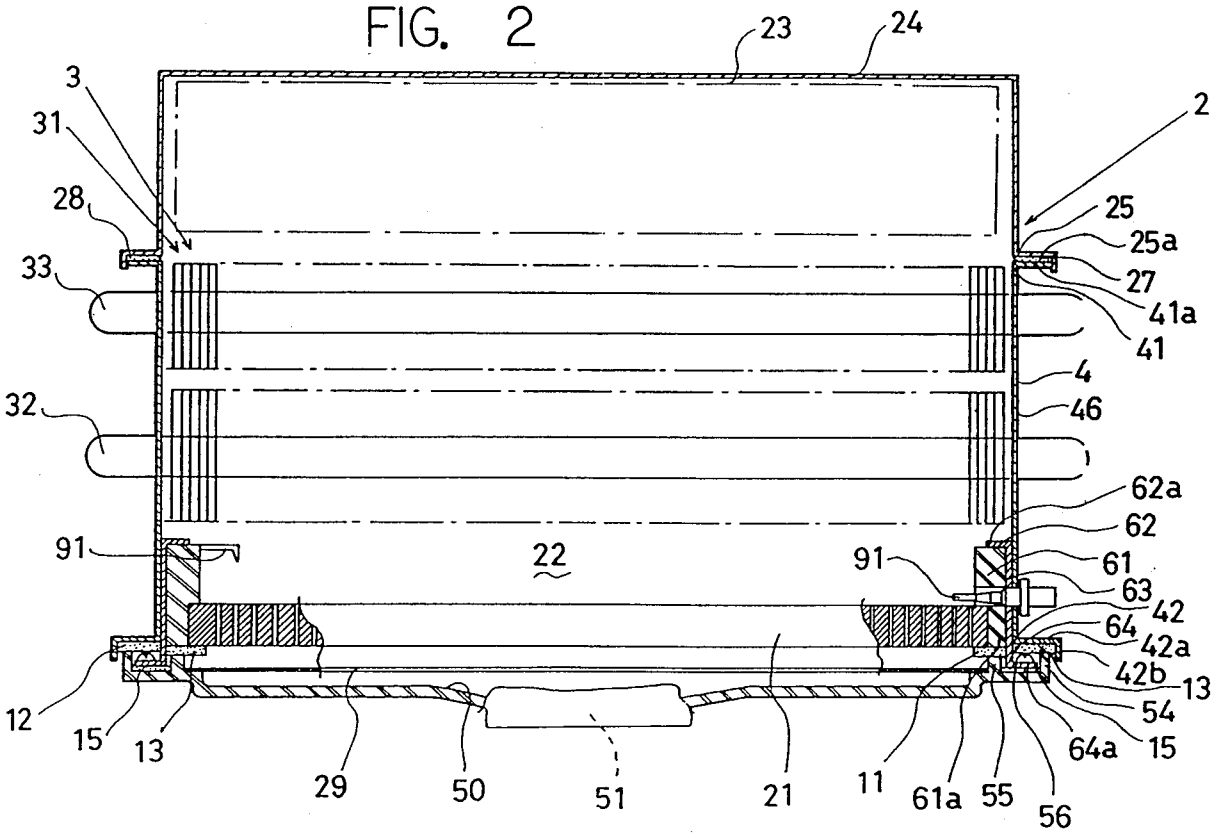
FIG. 2 is a main part sectional view of a water heater.

The invention is associated with a water heater, the preferred embodiment of which is described below. A water heater appliance 1 has an interconnection of a burner portion 2 having a heat exchanger 3, a burner case 4 and a scroll casing 73 which has an opening 72 and encloses a sirocco fan 71. The appliance 1 also has an electric motor (not shown) for driving the fan 71 which comprises a centrifugal blower 7, a fuel gas source 8, and an electronical control device 9. A burner portion 2 is mounted on a burner case 4 through a metal bracket 6, and having a burner chamber 22 which is equipped with a porous ceramic gas burner 21, and having an exhaust pan 24 provided with an exhaust opening 23 through which exhaust gas from the gas burner 21 passes.

Figure 3:
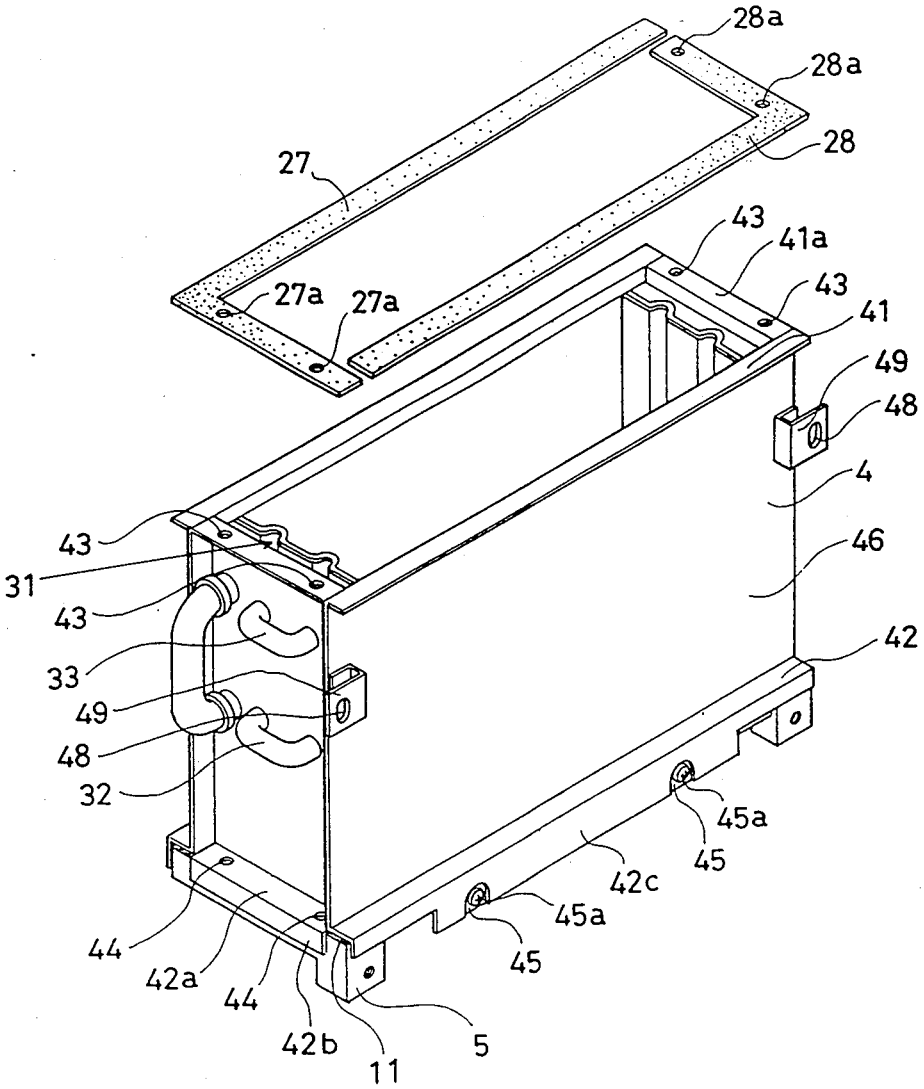
FIG. 3 is a perspective view of a burner case.

A heat exchanger 3 has a series of plate fins 31, a water pipe 32 and a hot water pipe 33 placed between the burner 21 and the exhaust opening 23 to allow the water from the upper reach of a supply pipe 32 to flow out hot water through the hot water pipe 33 by thermal transfer action of the heat exchanger at the burner chamber 22. The burner case is, as shown in FIG. 3, in the shape of a rectangular cylinder having upper and lower ends 41, 42, each having flanges 41*a*, 42*a* at its outer surface. The flange 41*a* has screw holes 43, while the flange 42*a* has screw holes 44. The flange 42*a* also has a screw hole (invisible in FIG. 5 screened by a screw 45*a*), at the back wall 42*c* of the lower extension 42*b*. This screw hole of the back wall 42*c* positions at the recessed portion 45, the thickness of which is reduced more than the other area of the back wall 42*c*. Only the inner part of the recessed portion 45 is in contact with a burner body 5. The exhaust pan 24 has its lower end securing a flange 25 in correspondence with the flange 41*a* of the burner case 41. The flange 41*a*, 25*a* are L-shaped and provided with screw holes 27*a*, 28*a* to be laminated each other through thermally insulated plates 27, 28 which individually serve as gaskets. The burner case 4 has a back wall 46 having a metal bracket 49 which fixes the case 4 to the back wall 47*a* of a case body 47. The metal bracket 49 has a screw hole 48.

Figure 4:
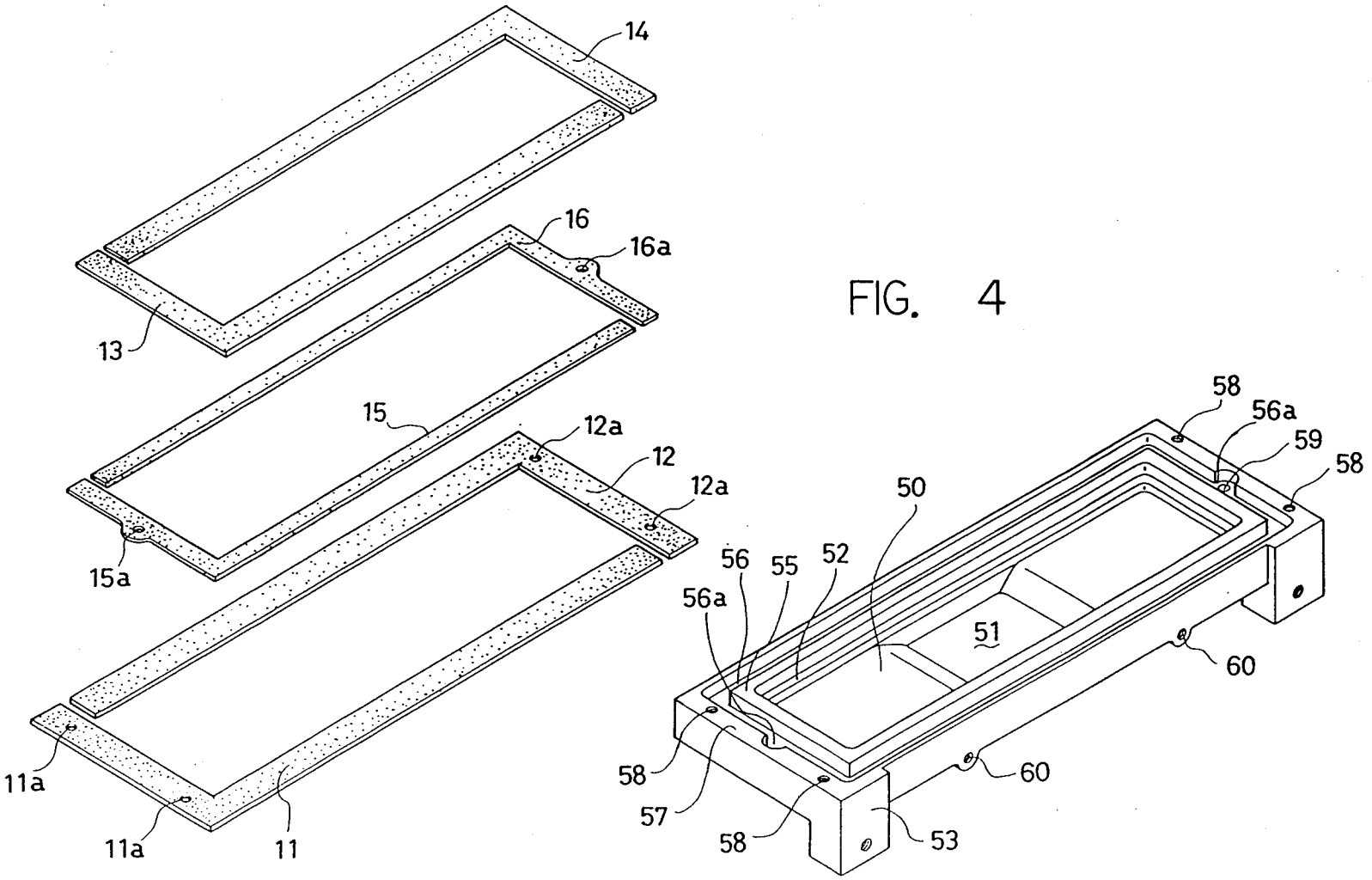
FIG. 4 is an exploded perspective view of a burner body.
Figure 7:
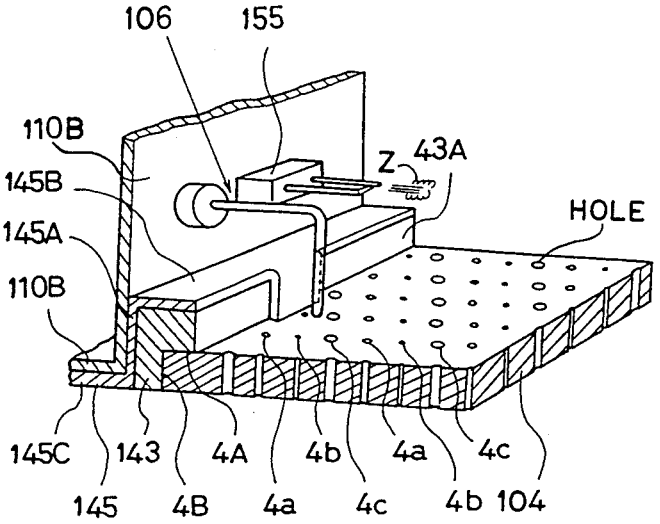
FIG. 7 and FIG. 8 are main part perspective views of a water heater.
Figure 8:
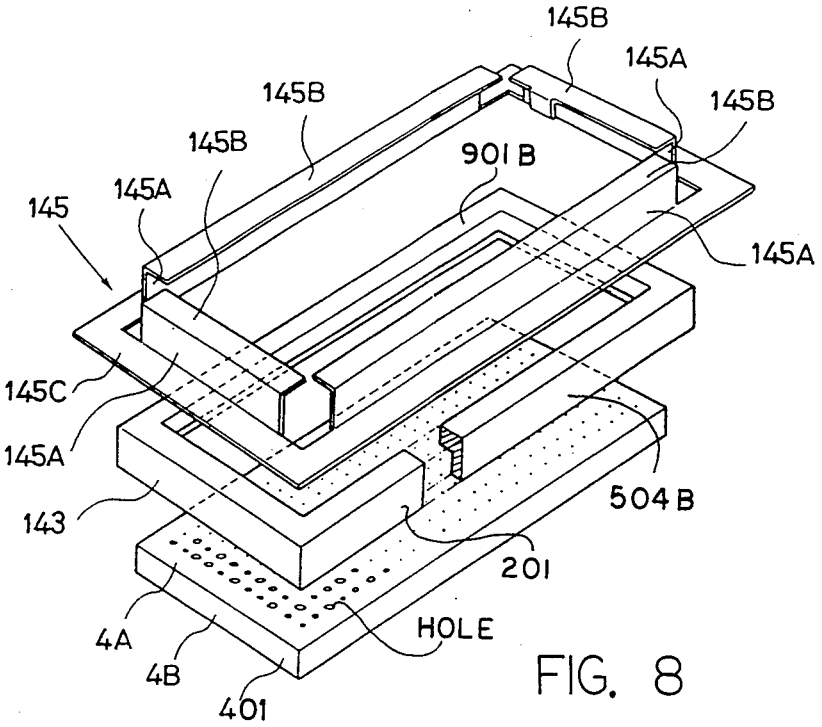

On the other hand, the cylindrical burner body 5 is integrally formed by means of aluminum die-casting as readily seen in FIG. 4.

The burner 5 has an open upper end and lower bottom 50 having a central inlet 51. The burner body 5 also forms a groove 56 between first and second projections 54, 55 at the peripheral, at the same time having a stepped portion 52 which receives a rectifier plate 29. Screw holes 58, 59 are provided with the upper end 57 of the first projection 54 and a semi-circular recess 56*a* of the groove 56. The burner body 5 has a side wall at its periphery in which a screw hole 60 is provided. The upper end 57 of the first projection 54 and the lower end 42 of the flange 42*a* are each laminated by means of a screw (not shown) through electrically insulated L-shaped plates 11, 12. The insulated plates 11, 12 act as gaskets respectively. The lower extension 42*b* of the burner case 4 and the burner body 5 are arranged to keep both separated from each other at a predetermined distance. The second projection 55, the gas burner 21, its peripheral 21*a* and lower end 61*a* of a fire-resistant ceramic frame 61 into which the burner plate 21 is fitted, are each laminated by means of a screw through second insulator plates 13, 14 each of which is in the form of an L-shape.

Meanwhile, the metal bracket 6 is arranged in direct contact with the inner wall of the burner case 4 as seen in FIG. 5. The metal bracket 6 is in the form of a rectangle of stainless steel to place the frame 61 in position with a flange 62*a* and a side wall 63. The metal bracket 6 also has a lower end 64 acting as a flange 64*a* which has a screw hole 65 at the semi-circular lug 65*a*. The flange 64*a* is in L-shape form, having screw holes 15*a*, 16*a*, and fixedly placed on the groove 56 through third insulator plates 15, 16 which serve as gaskets individually. The semi-circular lug 65*a* interfits into the recess 56*a* of the groove 56 which acts to keep the predetermined distance between the inner and outer surfaces of the metal bracket 6 and the burner body 5 so as to be in no contact therewith.

It is appreciated that the frame 61 may be integral with the gas burner 21. However, it is desirable that the frame 61 and burner 21 are individual as described in the above embodiment to avoid increased thermal shock.

The first, second and third insulator plates 11–16 and other insulator plates 27, 28 are laminated to each other, and thin aluminum leaf is sandwiched between the insulator plates for reinforcement thereof.

It is noted that those insulator plates may preferably be made from fire-resistant and low thermal conductivity materials. In this embodiment, the insulator plates are made from formed glass wool or and glass fibre, respectively having thermal conductivity of 0.056 kcal/m.h.deg or 0.036 kcal/m.h.deg. A gas supply path 8 which is integral with a scroll casing 73 comprises a nozzle 81 which emits fuel gas, a pipe 82 which introduces the fuel gas into the nozzle 81 and gas control unit 83. The gas control unit 83 is placed between the nozzle 81 and the pipe 82, and carries an electromagnetic valve 84, a governor valve (not shown) which regulates gas flow, and an electromagnetic control valve 85 which varies the opening degree according to the amount of energization. The nozzle 81 has one end which is provided with an orifice 86 to regulate pressure and flow of the gas.

In so doing, an electronic control circuit 9, which energizes and deenergizes the gas control unit 83, has a switch (not shown) which is ON-actuated with the use of the water heater 1. A temperature adjustable knob (not shown) which determines the temperature of water from the pipe 33. An electrode 92 sparks at the gas burner 21 in response to the quantity of oxygen gas of the flame from the gas burner 21, and an electric motor (not shown) of a centrifugal blower.

In operation, the water heater 1 calls ON-actuation of the switch to energize the blower 7 so as to rotate the fan 71. The fan 71 thus rotated draws air through the inlet 72 and supplies it to the gas burner 21.

The electronic control circuit 9 actuates the gas control unit 83 to open the valve 84 and the control valve 85. The fuel gas is introduced into the scroll casing 73 to mix with air. The mixture gas thus formed passes the inlet 51 of the burner body 5, and is ignited by the spark of the electrode 92 to burn on the gas burner 21.

In this situation, the exposed portion (flange 62*a*) of the metal bracket 6 is subjected to the flame from the burning gas to make the inner surface of the fire-resistant frame 61 to increase the temperature of the side wall 63 of the metal bracket 6 and the flange 64*a* as high as 400 degrees centigrade. The burner case 4 which contacts the side wall 63 of the metal bracket 6 increases in temperature up to 150 degrees centigrade by the thermal conductive action from the metal bracket 6 to the pipe 33 through the burner case 4, a series of plate fins 31, the heat exchanger 3 and the pipe 32.

With the structure, the burner case 4, the metal tool 6, the peripheral 21*a* of the gas burner 21, frame 61 and the first and second projections 54, 55 of the groove 56 of the burner body 5 are laminated through the first, second and third insulator plates 11–16.

Owing to this fact, the burner body 5, in which the temperature has risen to 110 degrees centigrade as in the prior art counterparts, is capable of controlling its temperature under 80 degrees centigrade, thus making it possible to introduce the mixture gas smoothly. With the burner body 5 under 80 degrees centigrade, the temperature of the scroll casing 73 is controlled as low as 55 degrees centigrade, in contrast to the prior art in which the casing 73 raises its temperature to 70 degrees centigrade. The low temperature of the scroll casing 73 enables precise functioning of the motor, the valve 84 and the control valve 85 so as to prevent malfunction thereof, obviating the suspension of air-drawing action and abnormal supply of the fuel gas. This also eliminates the generation of carbon monoxide due to the incomplete combustion under the low oxygen concentration, and the release of the fuel gas due to the flame extinction under the low fuel gas concentration.

It should be appreciated that the insulator plates need not be confined to only sheet-like configuration. Other shapes may be considered.

It is also noted that the invention should be applied to a burner appliance having a gas burner except for plate-like ones. The invention may also be applied to an air-heating apparatus.

Further, it is appreciated that a burner body and a scroll casing may be integral with each other.

Another embodiment is described hereinafter. A water heater appliance has a burner box 101 comprising first case 110A having a mixture room therein, and second case 110B having a burner room therein. The appliance has a burner 101 which is disposed to project into the inside of the second case 110B. The appliance also has a heat exchanger unit 102 having a series of plate fins 21 and conduits 122, the plate fins 121 being welded to the inner wall of the burner box 101, and arranged at the lower reach of the second case 110B. The appliance has a control unit 105 of the burner plate 104 which is enclosed into a housing 103 having an inlet 113 at the lower part of the side wall. The second case 110B is in a rectangular shape in section, and has an exhaust opening 110C at the upper end which communicates with an exhaust cylinder 11, and has an open end at the lower portion. The first case 110A is disposed on the lower open end to close the opening. On a flange 112 which is provided with the upper peripheral of the first case 110A, is seated a porous burner plate 104, which is made from fire-resistant and electrically insulated material such as ceramics. To the inside of the first case are an air supply blower 113 and a gas supply pipe 117 having a nozzle 115 adjacent an outlet of the blower 113 to constitute the burner 1A. The burner plate 104 has a series of small fire holes 4*a*, 4*b*, . . . 4*n*, the diameter of each of which is different in order to vary the drag produced when air passes therethrough. This structure allows diversification of the frequencies generated at the holes to avoid the resonance which may occur inside of the burner box 101 or the exhaust cylinder 11 to control the noise caused therefrom. The burner plate 104 is interfitted into a fire-resistant ceramic frame 143 to hold the peripheral and outer side of the plate 104.

The burner plate 104 and the fire-resistant frame 143 are held in position by a metal bracket 145 made from stainless steel. The metal bracket 145 comprises a side plate 145A which is tightly interfit with the outer side wall 43A of the fire-resistant frame 143, a plate 145B which engages with the upper surface of the frame 143, and a flange 145C which extends from the lower portion of the side plate 145A. The metal bracket 145 holds the fire-resistant frame 143 in proper position, and at the same time, interfitting the side plate 145A into the lower portion of the second case 110B. The flange 145C is sandwiched between a flange 110D formed at the lower end of the second case 110B and a flange 112 provided with the mixture box 114, and fixed by means of a bolt 119.

It is appreciated that the fire-resistant frame 143 may be integral with the burner plate 104. However, it is desirable that the fire-resistant frame 143 be discrete from the burner plate 104 for the improvement of thermal shock as described in the above embodiment.

The control unit 105 comprises a pair of flame rods 106 consisting of electrodes on the burner plate 104 to detect whether flame on the burner plate 104 is present or not, a safety valve 151, a flow control valve 153, an igniter consisting of diploe sparkers 155, 157 and an electronic control circuit 150 which controls the igniter and an electric motor M of the blower 113 while automatically closing the safety valve 151 when the flame rod 106 detects misfire and failure to ignite.

According to the described water heater, even when the burner compartment is filled with flame, and the inner of the second case 110B is exposed to the flame, the thermal conduction is executed smoothly from the second case 110B to the conduit 122 through the plate fins 121, and the heat exchanger 102, thus lessening the temperature rise of the second case 110B so as to sustain long service life in practical use.

The burner plate 104 is arranged to project inside of the second case 110B, thus preventing the inner wall of the first case 110A from being exposed to the flame so as to control abnormal temperature rise thereon.

Although a specific embodiment has been shown and described herein for purposes of illustration, it will be evident to those skilled in the art that the invention is capable of various modifications and adaptations within the scope of the appended claims. That is to say, changes and modifications in the specifically described embodiments can be carried out without departing from the scope of the invention, which is intended to be limited by the scope of the appended claims. Otherwise, the invention has been described in various forms which are intended to be explanatory and not to be taken in a limiting sense, since various changes in the parts, construction and arrangement may be effected without departing from the scope of the invention as set forth in the following claims. The various modifications of the invention disclosed above may be further modified within the scope of the appended claims. The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

We claim:

1. A burner apparatus comprising:
a blower;
a burner case;
a gas burner having a burner body into which a mixture of air and gas fuel is introduced, including a groove at the peripheral portion formed by first and second projections, the burner body being mounted to the burner case by a metal bracket attached to the outer peripheral portion of the burner body; wherein the first projection is separated from the burner case by a first insulator, the second projection is separated from the burner plate by a second insulator, and the groove is separated from the metal bracket by a third insulator.

2. The burner apparatus of claim 1, wherein the gas burner is made from ceramic plate having a plurality of fire holes.

3. The burner apparatus of claim 1, wherein the burner body is connected to a scroll casing having a nozzle connected to a gas supply pipe including an electromagnetic valve, and a fan for inducing gas into the burner body.

4. The burner apparatus of claim 1, wherein the blower comprises an electric motor and a fan.

5. The burner apparatus of claim 1, wherein the blower comprises a centrifugal-type fan which may be manufactured from porcelain ceramic fire-enduring material.

* * * * *

UNITED STATES PATENT AND TRADEMARK OFFICE

CERTIFICATE OF CORRECTION

PATENT NO. : 4,737,102

DATED : April 12, 1988

INVENTOR(S) : Jinno and Ishikawa

It is certified that error appears in the above-identified patent and that said Letters Patent are hereby corrected as shown below:

Column 3, line 1, after "14" insert --,--.

Column 3, line 29, after "or" delete --and--.

Column 4, line 44, change "21" to --121--.

Signed and Sealed this

Fourth Day of October, 1988

*Attest:*

DONALD J. QUIGG

*Attesting Officer*

*Commissioner of Patents and Trademarks*